US010190815B2

(12) United States Patent
Kempfle

(10) Patent No.: US 10,190,815 B2
(45) Date of Patent: Jan. 29, 2019

(54) DOMESTIC REFRIGERATION APPLIANCE

(71) Applicant: BSH HAUSGERAETE GMBH, Munich (DE)

(72) Inventor: Stephan Kempfle, Ellzee (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/316,187

(22) PCT Filed: Jun. 3, 2015

(86) PCT No.: PCT/EP2015/062344
§ 371 (c)(1),
(2) Date: Dec. 5, 2016

(87) PCT Pub. No.: WO2015/185604
PCT Pub. Date: Dec. 10, 2015

(65) Prior Publication Data

US 2017/0321953 A1 Nov. 9, 2017

(30) Foreign Application Priority Data

Jun. 5, 2014 (DE) ..... 10 2014 210 693

(51) Int. Cl.
*F25D 23/02* (2006.01)

(52) U.S. Cl.
CPC ..... *F25D 23/028* (2013.01); *F25D 2323/024* (2013.01)

(58) Field of Classification Search
CPC ..... F25D 23/028; F25D 23/02
USPC ..... 312/401, 405, 138.1, 319.5; 49/276
See application file for complete search history.

(56) References Cited

U.S. PATENT DOCUMENTS 3,628,845 A * 12/1971 Grimm ..... E05F 1/063 16/312
6,338,536 B1 1/2002 Ueno et al.
8,234,818 B2 8/2012 Hecht et al.
2010/0141107 A1* 6/2010 Kim ..... F25D 23/028 312/405

(Continued)

FOREIGN PATENT DOCUMENTS

DE 20301951 U1 6/2004
DE 102010020626 A1 11/2011

(Continued)

*Primary Examiner* — James O Hansen
(74) *Attorney, Agent, or Firm* — Laurence A. Greenberg; Werner H. Stemer; Ralph E. Locher

(57) ABSTRACT

A domestic refrigeration appliance includes a heat-insulated inner container delimiting a coolable interior for foodstuffs, a refrigeration device cooling the interior, a door leaf articulated by hinges for opening and closing the interior and an opening aid. At least one hinge is self-closing for automatically closing the door leaf up to a first opening angle. The opening aid includes an actuator and a tappet moving back and forth by the actuator between first and second positions. The opening aid enables the door leaf to be closed if the tappet is in the first position, to move the tappet from the first to the second position to push open the closed door leaf using the tappet up to a second opening angle smaller than the first opening angle, and to automatically move the tappet into the first position immediately or with a time delay after reaching the second position.

4 Claims, 3 Drawing Sheets

(56) References Cited

U.S. PATENT DOCUMENTS

2010/0307189 A1* 12/2010 Keller ..... F25D 17/047
62/449

FOREIGN PATENT DOCUMENTS

| | | | |
|---|---|---|---|
| EP | 1077354 | A2 | 2/2001 |
| EP | 2660543 | A2 | 11/2013 |
| WO | 2007009783 | A1 | 1/2007 |

* cited by examiner

DOMESTIC REFRIGERATION APPLIANCE

BACKGROUND OF THE INVENTION

Field of the Invention

The invention relates to a domestic refrigeration appliance comprising an opening aid device which is designed to assist an opening of a door leaf or the pulling-out of a drawer of the domestic refrigeration appliance.

DE 203 01 951 U1 discloses a domestic refrigeration appliance which comprises a door leaf and a door opening aid. The door opening aid comprises a motor, an eccentric and a tappet. In order to assist an opening of the door leaf, the eccentric moves the tappet from a retracted position into an extended position in which the tappet pushes the door leaf ajar. Subsequently, the door leaf is able to be manually opened further. After pushing open the door leaf, the eccentric moves the tappet back into the retracted position thereof so that the door leaf is able to be manually closed again.

WO 2007/009783 A1 discloses a further domestic refrigeration appliance comprising a door leaf and a door opening aid. The door opening aid comprises drive means, both for the automatic opening and for the automatic closing of the door leaf.

BRIEF SUMMARY OF THE INVENTION

It is the object of the present invention to provide a domestic refrigeration appliance comprising an opening aid device which is able to be operated more reliably and which is designed to assist an opening of a door leaf or the pulling-out of a drawer of the domestic refrigeration appliance.

The object of the invention is achieved by a domestic refrigeration appliance comprising a heat-insulated inner container which delimits a coolable interior for storing foodstuffs, a refrigeration device for cooling the coolable interior, a door leaf mounted relative to the inner container in an articulated manner relative to an axis by means of hinges for opening and closing the coolable interior, wherein at least one of the hinges is configured as a self-closing hinge capable of automatically closing the door leaf to a first opening angle, and an opening aid device which comprises an actuator and a tappet, which can be moved at least indirectly back and forth by means of the actuator between a first position and a second position, and which is configured to enable the door leaf to be closed if the tappet is in the first position thereof, to move the tappet from the first position thereof to the second position thereof in order to push open the closed door leaf by means of the tappet to a second opening angle which is smaller than the first opening angle, and to move the tappet automatically into the first position thereof immediately or in a time-delayed manner after the second position has been reached.

The domestic refrigeration appliance according to the invention comprises the heat-insulated inner container which delimits the coolable interior. The coolable interior is provided for storing foodstuffs and is cooled by means of the refrigeration device. Said refrigeration device is preferably configured as a refrigerant circuit, known in principle by the person skilled in the art, and is preferably designed such that it cools the coolable interior at least approximately to a predetermined temperature. The coolable interior is provided for storing foodstuffs.

The inner container is heat-insulated by the domestic refrigeration appliance preferably comprising, for example, a heat-insulating foam which, in particular, bears against the surface of the inner container remote from the coolable interior.

The domestic refrigeration appliance further comprises the door leaf which is mounted relative to the coolable interior in an articulated manner. The door leaf is mounted in an articulated manner by means of a hinge relative to an axis which extends, in particular, vertically. At least one of the hinges is configured as a self-closing hinge. Self-closing hinges comprise a spring which automatically moves the door leaf from an open position into the closed position. The at least one self-closing hinge of the domestic refrigeration appliance according to the invention is configured to close the door leaf automatically up to the first opening angle, i.e. when the door leaf is opened up to and including this first opening angle, and for example not held by a person, it closes automatically. If the door leaf is opened further than the first opening angle, then the at least one self-closing hinge does not act on the door leaf, in order to permit the door leaf to remain open. The first opening angle is, for example, a maximum of 45°, preferably 30.

The domestic refrigeration appliance further comprises the opening aid device. This device comprises the actuator which is configured, for example, as an electric motor in order to move the tappet of the opening aid device automatically back and forth at least indirectly between the two positions. The opening aid device is preferably an electronic opening aid device. The opening aid device assists an opening of the door leaf by the tappet pushing open the closed door leaf by the second opening angle, when moving from the first position into the second position. After reaching the second position, the tappet automatically moves into the first position thereof immediately or in a time-delayed manner and thus permits a closing of the door leaf. Since the second opening angle is smaller than the first opening angle, the at least one self-closing hinge is able to close again automatically the door leaf pushed open by means of the tappet to the second opening angle, if for example a person does not wish to open the door leaf. As a result, it may also be achieved that, in the case of false activation of the opening aid device, the door leaf does not remain open but is automatically closed again due to the at least one self-closing hinge.

Instead of the door leaf, the domestic refrigeration appliance according to the invention may also comprise at least one self-closing drawer which is able to be at least partially pulled out of the coolable interior and which is designed to be able to move automatically into the coolable interior into a closed position, to a first distance by which the drawer is partially pulled out of the coolable interior. In this case, the opening aid device is configured to enable the drawer to be closed if the tappet is in the first position thereof, to move the tappet from the first position thereof to the second position thereof in order to push the closed drawer partially out of the coolable interior by means of the tappet by a second distance which is shorter than the first distance, and to move the tappet automatically into the first position thereof immediately or in a time-delayed manner after the second position has been reached.

A self-closing drawer comprises a spring which automatically pulls the drawer, which has been pulled out of the coolable interior, into the coolable interior. The self-closing drawer of the domestic refrigeration appliance according to the invention is configured to close the drawer up to the first distance by which the drawer is partially pulled out of the coolable interior, i.e. when the drawer is partially pulled out of the coolable interior up to and including this first distance, and for example is not held by a person, it automatically closes. If the drawer is pulled further than the first distance out of the coolable interior, then the spring no longer acts on the drawer in order to permit the drawer to remain open.

In the case of the domestic refrigeration appliance according to the invention with the self-closing drawer, the opening aid device assists the pulling-out of the drawer from the coolable interior by the tappet pushing the closed drawer out of the coolable interior with a movement from the first position into the second position by the second distance. After reaching the second position the tappet automatically moves into the first position thereof, immediately or in a time-delayed manner, and thus permits a closing of the drawer. Since the second distance is shorter than the first distance, the self-closing drawer which has been pushed out of the coolable interior by means of the tappet as far as the second distance, is able to close again automatically if, for example, a person does not wish to open the self-closing drawer. As a result, it may also be achieved that in the case of false activation of the opening aid device, the self-closing drawer does not remain open but is automatically closed again.

The opening aid device is preferably arranged centrally relative to the inner container in order to permit the stop of the door leaf to be replaced and/or the self-closing drawer to be pulled out correctly.

It is also possible that the domestic refrigeration appliance according to the invention comprises two coolable interiors for storing foodstuffs, one coolable interior thereof being provided with the self-closing drawer and the other coolable interior thereof being provided with the door leaf mounted by means of hinges, at least one of the hinges thereof being configured as the self-closing hinge. In this case, the self-closing drawer and the door leaf are respectively assigned a corresponding opening aid device.

According to one embodiment of the domestic refrigeration appliance according to the invention this appliance is configured such that, by pushing on the closed door leaf and/or on the closed drawer, the opening aid device automatically moves the tappet, in particular in a time-delayed manner, from the first position thereof into the second position thereof. In this case, the desire of a person to open the door leaf and/or the drawer is indicated by the door leaf and/or the drawer being pushed. Pushing on the drawer and/or on the door leaf may, for example, be identified by evaluating the pressure inside the coolable interior or the alteration of said pressure. To this end, the domestic refrigeration appliance according to the invention comprises, for example, a pressure sensor and evaluates the output signals thereof. If the door leaf and/or the drawer is pushed, the pressure increases inside the coolable interior. If the door leaf and/or the drawer is pushed, therefore, according to this variant the opening device preferably moves the tappet from the first position thereof into the second position thereof by a time period of, for example, 0.5 s in a time-delayed manner in order to assist the opening of the door leaf and/or the drawer. By opening the door leaf and/or the drawer in a time-delayed manner, the opening aid device is prevented from pushing the door leaf and/or the drawer against the person during the pushing procedure. After the time period of, for example, 0.5 s has passed, the door leaf and/or the drawer opens automatically by a gap and/or by the second distance in order to enable the person to open the door leaf and/or the drawer further by hand.

Preferably, the domestic refrigeration appliance according to the invention is configured such that, after pushing on the closed door leaf and/or on the closed drawer, the opening aid device automatically moves the tappet for a time period of, for example, 3 s in a time-delayed manner from the second position thereof into the first position thereof. As a result, the opening device holds the door leaf and/or the drawer slightly open for this time period. Consequently, the person has sufficient time to open the door leaf and/or the drawer further before said door leaf and/or said drawer is closed again automatically.

The domestic refrigeration appliance according to the invention may be accordingly configured such that the opening aid device is activated by pushing on the door leaf, in particular on the front thereof and/or on the drawer. In particular, after a short waiting time, the door leaf is pushed as far as the second opening angle. At the same time an opening gap of, for example, a few centimeters is produced. In this position, the door leaf is preferably held by the opening aid device until the person grips the door leaf. For example, after a set time period of, for example, 3 s the opening aid device retracts its tappet again. Thus the door leaf automatically closes again if the person has not fully opened the door leaf. In this case, the type of closure may be correspondingly influenced by the speed profile of the return movement of the tappet of the opening aid device. The opening gap of the door leaf is adapted to the respective self-closing hinge. This means that the second opening angle which is implemented by the opening aid device is smaller than the first opening angle, the self-closing action of the self-closing hinge still being effective up to said first opening angle. In drawers, i.e. self-closing drawers, the extended path (second distance) is not greater than the path (first distance) which the drawer and/or the self-closing drawer is able to travel back automatically.

According to one embodiment of the domestic refrigeration appliance according to the invention, said domestic refrigeration appliance is configured such that by pulling on the closed door leaf and/or by pulling on the closed drawer, the opening aid device automatically moves the tappet, in particular immediately, from the first position thereof into the second position thereof. To this end, the door leaf and/or the drawer may have a handle. In this case the desire of a person to open the door leaf and/or the drawer is indicated by the door leaf and/or the drawer being pulled. Pulling on the drawer and/or on the door leaf may be identified, for example, by evaluating the pressure inside the coolable interior or the alteration of said pressure. If the door leaf and/or the drawer is pulled, then the pressure inside the coolable interior is reduced. If the door leaf and/or the drawer is pulled, then according to this variant the opening device moves the tappet from the first position thereof into the second position thereof in order to assist the opening of the door leaf and/or the drawer. Preferably, the opening device moves the tappet immediately from the first position thereof into the second position thereof in order to assist the person when pulling on the door leaf and/or on the drawer, as far as possible without a time delay.

Preferably, after pulling on the closed door leaf and/or on the closed drawer, the opening device of the domestic refrigeration appliance according to the invention automatically moves the tappet immediately from the second position thereof into the first position thereof. Thus the door leaf and/or the drawer would immediately close again automatically if the person were not to hold open or open further the door leaf and/or the drawer.

According to a further variant of the domestic refrigeration appliance according to the invention, the time period in which the opening aid device moves the tappet from the first position into the second position, by pulling on the closed door leaf, and/or on the closed drawer is shorter than the time period in which the opening aid device moves the tappet from the first position into the second position, by pushing on the closed door leaf. This results, for example, in a damped automatic opening of the door leaf as far as the second opening angle and/or a damped automatic opening of the drawer by the second distance as a result of a pushing action. When pulling, however, greater assistance is provided for the opening of the door leaf and/or the drawer, due to the more rapid reaction of the opening aid device.

Preferably, the opening aid device of the domestic refrigeration appliance according to the invention reacts substantially more rapidly when pulling on the door leaf and/or on the drawer than when pushing, in order to assist the person immediately with the pulling action. The assistance is preferably provided only in a relatively small region in order to reduce, in particular, the relatively high forces in the initial opening region, caused for example by the low pressure of the coolable interior or the inertia of the door leaf. After the door leaf is separated from the inner container or a body of the domestic refrigeration appliance and before the end of the self-closing region, the assistance by the opening aid device is terminated. Then, preferably immediately, the opening aid device moves the tappet back into the first position thereof and the person is able to close the door leaf and/or the drawer again as if no opening aid device were present. If the person releases the door leaf immediately after the operating region assisted by the opening aid device, however, it closes again by itself.

BRIEF DESCRIPTION OF THE SEVERAL VIEWS OF THE DRAWING

Exemplary embodiments of the invention are shown by way of example in the accompanying schematic drawings, in which.

DESCRIPTION OF THE INVENTION

Figure 1:
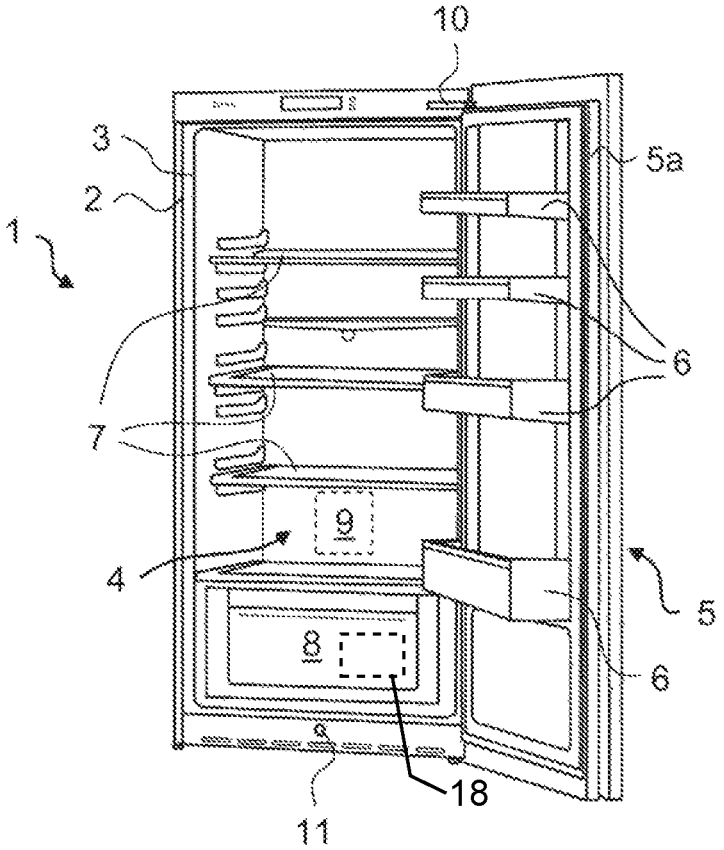
FIG. 1 shows a domestic refrigeration appliance in a perspective view.
Figure 2:
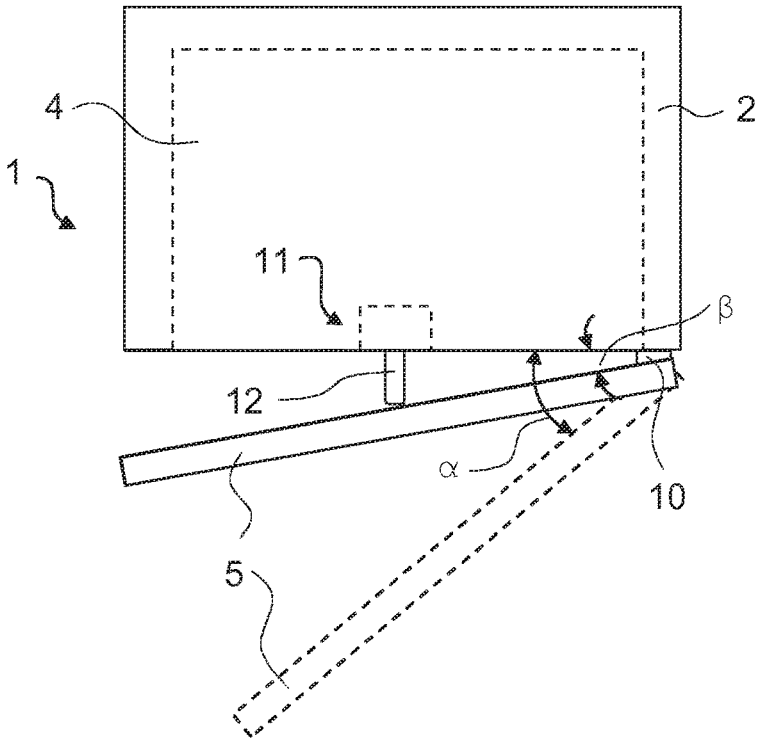
FIG. 2 shows a plan view of the domestic refrigeration appliance.

FIG. 1 shows a domestic refrigeration appliance 1 in a perspective view and FIG. 2 shows the domestic refrigeration appliance 1 in a plan view.

The domestic refrigeration appliance 1 comprises a body 2 with a heat-insulated inner container 3 which defines a coolable interior 4. The coolable interior 4 is provided for storing foodstuffs, not shown in more detail.

In the case of the present exemplary embodiment, the domestic refrigeration appliance 1 has a door leaf 5 mounted in an articulated manner for closing the coolable interior 4. The door leaf 5 is mounted in an articulated manner, in particular, relative to a vertically extending axis, not shown. When the door leaf 5 is open, as shown in FIG. 1, the coolable interior 4 is accessible. The door leaf 5 is mounted in an articulated manner by means of hinges relative to the heat-insulated inner container 2. The hinges are fastened, for example, to the body 2.

On the side of the door leaf 5 oriented in the direction of the coolable interior 4, in the case of the present exemplary embodiment a plurality of door compartments 6 are arranged for storing foodstuffs. In particular, a plurality of shelves 7 are arranged in the coolable interior 4 for storing foodstuffs and, in particular, a drawer 8 is arranged in the lower region of the coolable interior 4, foodstuffs also being able to be stored therein.

The domestic refrigeration appliance 1 further comprises a door seal **5*a* fastened to the side of the door leaf 5 oriented in the direction of the coolable interior 4**.

The domestic refrigeration appliance 1 comprises a device 18 having a refrigerant circuit for cooling the coolable interior 4. In the case of the present exemplary embodiment, the refrigerant circuit comprises a compressor, a condenser arranged downstream of the compressor, a throttle device which is arranged downstream of the condenser and which is designed, in particular, as a throttle tube or capillary tube, and an evaporator which is arranged between the throttle device and the compressor.

The domestic refrigeration appliance 1 is, for example, a domestic refrigeration appliance and/or may be designed as a so-called "No Frost" domestic refrigeration appliance.

In the case of the present exemplary embodiment, the domestic refrigeration appliance 1 comprises an electronic control device 9 which is designed to activate the refrigerant circuit, in particular the compressor thereof, in a manner generally known by the person skilled in the art, such that the coolable interior 4 has at least approximately a predetermined or predeterminable set temperature. The electronic control device 9 is preferably designed such that it controls the temperature of the coolable interior 4. In order to maintain the actual temperature of the coolable interior 4, if required, the domestic refrigeration appliance 1 may comprise at least one temperature sensor which is not shown in more detail and which is connected to the electronic control device 9.

At least one of the hinges of the domestic refrigeration appliance 1 is configured as a self-closing hinge 10. The self-closing hinge 10 comprises a pretensioned spring, not shown in more detail, which acts on the hinge 10 up to a first opening angle $\alpha$ by which the door leaf 5 is opened, and which automatically moves the door leaf 5 into its closed position due to the spring force exerted by the spring. The door leaf 5 opened by the first opening angle $\alpha$, is shown in dashed lines in FIG. 2. The first opening angle $\alpha$ is, in particular, less than or equal to 45° preferably approximately 30°.

Figure 3:
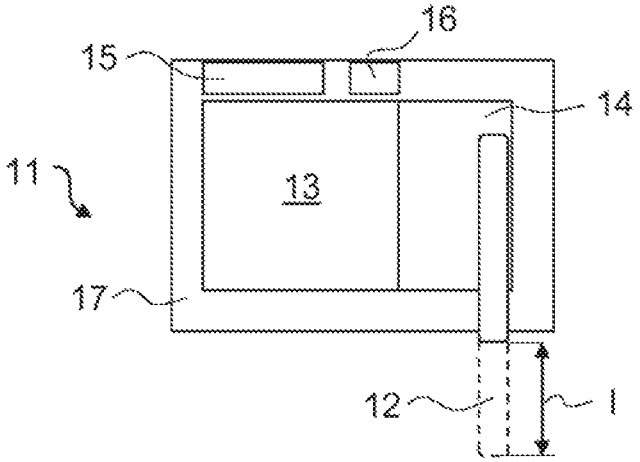
FIG. 3 shows an opening aid device of the domestic refrigeration appliance.

The domestic refrigeration appliance 1 further comprises an opening aid device 11, not shown in more detail, in FIG. 3. The opening aid device 11 of the domestic refrigeration appliance 1 is provided to assist an opening of the door leaf 5. The opening aid device 11, in the case of the domestic refrigeration appliance 1 shown in FIG. 1, is thus a door opening aid device.

In the case of the present exemplary embodiment, the opening aid device 11 is fastened in or on the body 2, preferably centrally relative to the door leaf 5. The opening aid device 11 comprises a tappet 12 which is able to be moved back and forth at least indirectly by means of an actuator, for example an electric motor 13, between a first position and a second position. In the case of the present exemplary embodiment, the opening aid device 11 comprises a gear mechanism 14 arranged between the tappet 12 and the electric motor 13. The electric motor 13 and the gear mechanism 14 are arranged inside a housing 17 and the tappet 12 protrudes, at least in the second position thereof, at least partially from the housing 17.

Figure 5:
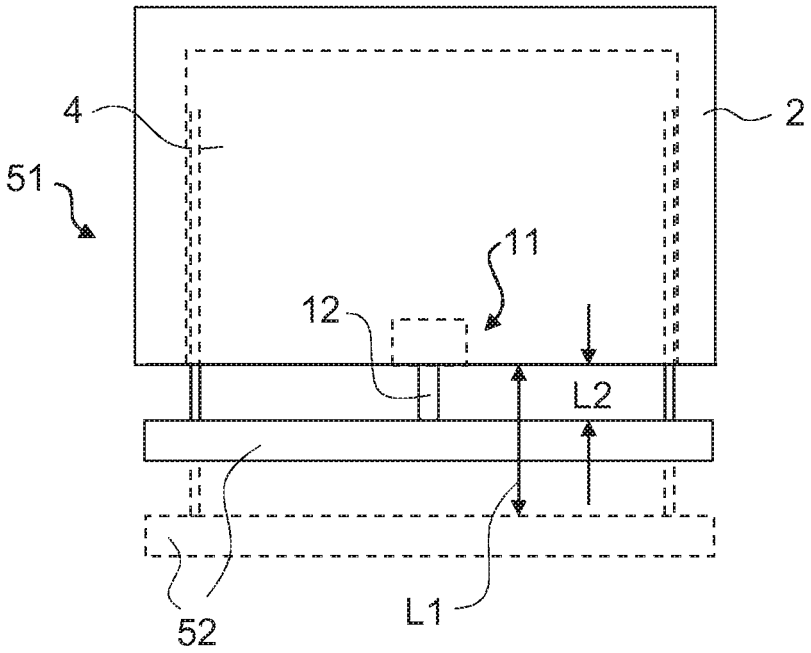
FIG. 5 shows a plan view of a further domestic refrigeration appliance.

The opening aid device 11 is provided to push open the door leaf 5 automatically from its closed position to a second opening angle β by means of the tappet 12, so that from there the door leaf 5 is able to be opened manually in a simpler manner in order to be opened fully. The door leaf 5 in the position opened by means of the tappet 12 to the second opening angle β is shown in FIG. 5 by solid lines.

In the first position thereof, the tappet 12 is retracted and enables the door leaf 5 to be closed. In the second position thereof, the tappet 12 is extended by a predetermined distance l, of for example 35 mm, and pushes the door leaf 5 ajar to the second opening angle β. The tappet 12 in the first position thereof is shown in FIG. 3 by solid lines and in the second position thereof by dashed lines.

The self-closing hinge 10 and the opening aid device 11 are adapted to one another such that the second opening angle β, by which the tappet 12 opens the door leaf 5, is smaller, preferably substantially smaller, than the first opening angle α within which the self-closing hinge 10 is able to close the door leaf 5 automatically.

In the case of the present exemplary embodiment, the opening aid device 11 is activated by means of a separate electronic control device 15. The electronic control device 15 is arranged, in particular, inside the housing 17. It is, however, also possible that the opening aid device 11 is activated by the electronic control device 9 activating the refrigerant circuit. It may also be provided that both electronic control devices 9, 15 are able to communicate with one another.

In the case of the present exemplary embodiment, it is provided that if the electronic control device 15 identifies that a person wishes to open the door leaf 5, the electronic control device 15 activates the electric motor 13, such that the tappet 12 moves from the first position thereof into the second position thereof in order to open the door leaf 5 to the second opening angle β. After the tappet 12 is in the second position thereof and the door leaf 5 has been pushed ajar, the electronic control device 15 activates the electric motor 13 again after a predetermined time period or immediately so that the tappet 12 moves from the second position thereof into the first position thereof. If the person now does not wish to open the door leaf 5 further, the door leaf 5 closes automatically due to the self-closing hinge 10.

In the case of the present exemplary embodiment, the desire of the person to open the door leaf 5 may be manifested by pushing or pulling on the closed door leaf 5.

In order to identify the pulling or pushing on the door leaf 5, in the case of the present exemplary embodiment the domestic refrigeration appliance 1, in particular the opening aid device 11 thereof, comprises a pressure sensor 16, the electronic control device 15 of the opening aid device 15 accordingly being able to evaluate the output signals thereof. If the person pulls on the door leaf 5 in order to open said door leaf, the air pressure inside the coolable interior 4 is reduced. This is identified by the electronic control device 15 due to the output signals produced by the pressure sensor 16. If, however, the person pulls on the closed door leaf 5 the pressure inside the coolable interior 4 increases. This is also identified by the electronic control device 15 due to the output signals produced by the pressure sensor 16.

Figure 4:
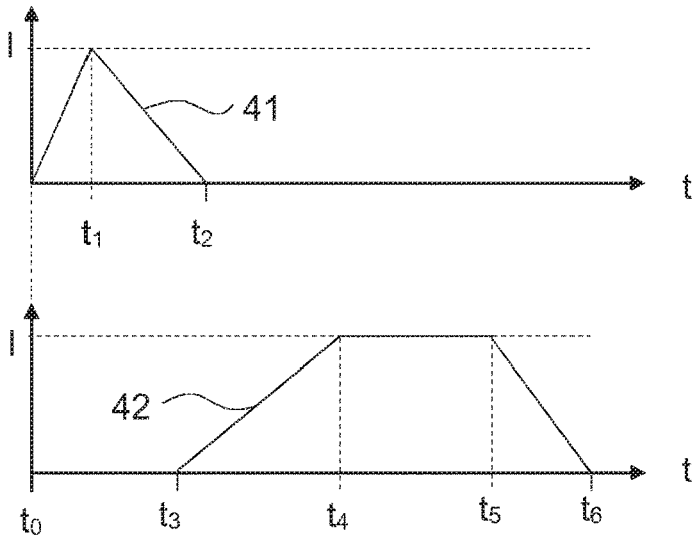
FIG. 4 shows a diagram for illustrating the operation of the opening aid device.

In the case of the present exemplary embodiment, it is provided that the electronic control device 15 variously activates the electric motor 13 depending on the identified pulling or pushing on the door leaf 5. The time curves of this activation and/or the movement sequences of the tappet 12 resulting therefrom are shown in FIG. 4. This figure shows a first curve 41 which is assigned to the movement of the tappet 12 by pulling on the closed door leaf 5 and a second curve 42 which is assigned to the movement of the tappet 12 by pushing on the closed door leaf 5.

If the electronic control device 15 identifies pulling on the closed door leaf 5 at the time $t_o$ the tappet 12 is instantly moved from the first position thereof into the second position thereof, which it reaches at the time $t_1$. After reaching the second position at the time $t_1$ the tappet 12 is then immediately moved again into the first position thereof which it reaches at the time $t_2$.

The time period which the tappet 12 requires until it has reached the second position thereof at the time $t_1$, is preferably less than 0.4 s, preferably approximately 0.2 s. The time period which the tappet 12 requires for its movement between the second position and the first position is, in particular, longer than the time period for the movement from the first position into the second position. The time period for the movement of the tappet 12 from the second position into the first position is, for example, 0.5 s.

If the electronic control device 15 identifies pushing on the closed door leaf 5 at the time $t_o$ the tappet 12 is time-delayed, i.e. is automatically moved only after a time period of, for example, approximately 0.5 s at the time $t_3$ from the first position thereof into the second position thereof which it reaches at the time $t_4$.

The time period which the tappet 12 requires, after pushing on the door leaf 5 has been identified, until it has reached the second position thereof, at the time $t_4$, starting from the first position thereof at the time $t_3$, is longer than the corresponding time period when pulling on the door leaf 5 has been identified and is, for example, 1.0 s.

Before the tappet 12 is moved again from the second position thereof into the first position thereof, after pushing on the door leaf 5 has been identified, the tappet 12 pauses for a predetermined time period of, in particular, several seconds, for example 3.0 s in the second position thereof in order to be moved automatically at the time $t_5$ from the second position thereof into the first position thereof. The tappet 12 reaches the first position thereof at the time $t_6$. The time period for the movement of the tappet 12 from the second position into the first position is, for example, 0.5 s.

FIG. 5 shows a plan view of a further domestic refrigeration appliance 51. When not described differently, components of the domestic refrigeration appliance 51, shown in FIG. 5, which are structurally and functionally the same as components of the domestic refrigeration appliance 1, shown in FIG. 1, are provided with the same reference numerals.

The domestic refrigeration appliance 51 shown in FIG. 5 differs substantially from the domestic refrigeration appliance 1, shown in FIG. 1, in that it does not have a door leaf for opening and closing the coolable interior 4 but at least one self-closing drawer 52, which may be at least partially pulled out from the coolable interior 4 for loading with foodstuffs and may be pushed into the coolable interior 4 for storing the foodstuffs.

The self-closing drawer 52 comprises a pretensioned spring, which is not shown in more detail, which acts on the self-closing drawer 52 up to a first distance L1 by which the self-closing drawer 52 may be pulled out of the coolable interior 4 and due to the spring force exerted by the spring moves the self-closing drawer 52 automatically into its closed position where the drawer 51 is pushed fully into the coolable interior 4. The self-closing drawer 52, pulled out to the first distance L1 from the coolable interior 4, is shown in FIG. 5 in dashed lines. The self-closing drawer 52 is designed such that it is possible to pull it out further than the first distance L1 from the coolable interior 4.

The domestic refrigeration appliance 51 shown in FIG. 5 also comprises the opening aid device 11 which, however, is provided for the domestic refrigeration appliance 51, to push the self-closing drawer 51 automatically out of the coolable interior 4 from its closed position to a second distance L2 by means of the tappet 12, in order to facilitate pulling out the drawer 51 fully by hand. The drawer 52 pushed out to the second distance L2 is shown in FIG. 5 by solid lines.

In the first position thereof, the tappet 12 is retracted and permits the drawer 51 to be closed. In the second position thereof, the tappet 12 is extended by the predetermined distance l of, for example 35 mm, and pushes the drawer 51 by the second distance L2 out of the coolable interior 4.

The self-closing drawer 52 and the opening aid device 11 are adapted to one another such that the second distance L2 is shorter than the first distance L1.

In the case of the present exemplary embodiment, it is provided that when the electronic control device 15 identifies that a person wishes to pull out the drawer 51 from the coolable interior 4, the electronic control device 15 activates the electric motor 13 such that the tappet 12 moves from the first position thereof into the second position thereof in order to push the drawer 52 to the second distance L2 out of the coolable interior 4.

After the tappet 12 is in the second position thereof and the drawer 52 is pushed to the second distance L2 out of the coolable interior 4, the electronic control device 15 activates the electric motor 13 in a time-delayed manner or even immediately again so that the tappet 12 moves from the second position thereof into the first position thereof. If the person now does not wish to pull the drawer 52 out of the coolable interior 4, the drawer 52 automatically moves fully into the coolable interior 4 due to its self-closing feature.

In the case of the present exemplary embodiment, the desire of the person to pull the drawer 52 out of the coolable interior 4 may be manifested by pushing or pulling on the closed drawer 52.

In order to identify pulling or pushing on the drawer 52, in particular the pressure change inside the coolable interior 4 is evaluated by means of the electronic control device 15. If the person pushes on the closed drawer 52, the pressure increases inside the coolable interior 4. If the person pulls on the drawer 52, the pressure reduces inside the coolable interior 4.

In the case of the present exemplary embodiment, it is provided that the electronic control device 15 variously activates the electric motor 13 depending on the identified pulling or pushing on the drawer 52. The time curves of this activation and/or the resulting movement sequences of the tappet 12 correspond to the time curves 41, 42 for the opening of the door leaf 5 of the domestic refrigeration appliance 1.

If the electronic control device 15 identifies pulling on the closed drawer 52 at the time $t_o$ the tappet 12 is moved instantly from the first position thereof into the second position thereof which it reaches at the time $t_1$. After reaching the second position at the time $t_1$, the tappet 12 is immediately moved into the first position thereof which it reaches at the time $t_2$.

The time period which the tappet 12 requires until it has reached the second position thereof at the time $t_1$, is preferably less than 0.4 s, preferably approximately 0.2 s. The time period which the tappet 12 requires for its movement between the second position and the first position is, in particular, longer than the time period for the movement from the first position into the second position. The time period for the movement of the tappet 12 from the second position into the first position is, for example, 0.5 s.

If the electronic control device 15 identifies pushing on the closed drawer 52 at the time $t_o$ the tappet 12 is moved in a time-delayed manner after a time period of approximately 0.5 s at the time $t_3$, from the first position thereof into the second position thereof, which it reaches at the time $t_4$.

After pushing on the drawer 52 has been identified, the time period which the tappet 12 requires until it has reached the second position thereof at the time $t_4$, starting from the first position thereof at the time $t_3$, is longer than the corresponding time period when pulling on the drawer 52 is identified and is, for example, 1.0 s.

Before the tappet 12 is moved again from the second position thereof into the first position thereof, after pushing on the drawer 52 has been identified, the tappet 12 pauses for a predetermined time period of, in particular, several seconds, for example 3.0 s, in the second position thereof in order then to be moved at the time $t_5$ automatically from the second position thereof into the first position thereof. The tappet 12 reaches the first position thereof at the time $t_6$. The time period for the movement of the tappet 12 from the second position into the first position is, for example, 0.5 s.

It is also possible that the domestic refrigeration appliance 1 shown in FIG. 1 comprises a further coolable interior which is provided with a self-closing drawer and an opening aid 11 for this drawer, corresponding to the self-closing drawer 52 of the domestic refrigeration appliance 51 shown in FIG. 5.

LIST OF REFERENCE NUMERALS

1 Domestic refrigeration appliance
2 Body
3 Inner container
4 Coolable interior
5 Door leaf
**5*a*** Door seal
6 Door compartment
7 Shelves
8 Drawer
9 Electronic control device
10 Self-closing hinge
11 Opening aid device
12 Tappet
13 Electric motor
14 Gear mechanism
15 Electronic control device
16 Pressure sensor
17 Housing
41 First curve
42 Second curve
51 Domestic refrigeration appliance
22 Self-closing drawer
l, L1, L2 Distance
α, β Opening angle

The invention claimed is:

1. A domestic refrigeration appliance, comprising:

a heat-insulated inner container delimiting a coolable interior for storing foodstuffs;

a refrigeration device for cooling said coolable interior;

a door leaf for opening and closing said coolable interior;

hinges mounting said door leaf along an axis in an articulated manner relative to said inner container, at least one of said hinges being a self-closing hinge acting on said door leaf up to a first opening angle of said door leaf for automatically closing said door leaf; and an opening aid device including an actuator, a tappet being movable at least indirectly back and forth by said actuator between a first position and a second position, a sensor for identifying pushing on and pulling on said door leaf, and an electronic control device being activated by said sensor and being configured to operate said actuator:

to enable said door leaf to be closed if said tappet is in said first position, to move said tappet from said first position to said second position to push open said closed door leaf through a second opening angle being smaller than said first opening angle by using said tappet, to move said tappet automatically into said first position immediately or with a time delay after reaching said second position, to automatically move said tappet immediately from said first position into said second position upon pulling on said closed door leaf, and to automatically move said tappet from said first position into said second position with a time delay after said sensor identifies a pushing on said closed door leaf, in order to prevent said opening aid device from pushing said door leaf open during said pushing on said closed door leaf.

2. The domestic refrigeration appliance according to claim 1, wherein said opening aid device moves said tappet over a time period, and said time period in which said opening aid device moves said tappet from said first position into said second position by pulling on said closed door leaf is shorter than said time period in which said opening aid device moves said tappet from said first position into said second position by pushing on said closed door leaf.

3. The domestic refrigeration appliance according to claim 1, wherein said opening aid device automatically moves said tappet immediately from said second position into said first position after pulling on said closed door leaf.

4. The domestic refrigeration appliance according to claim 1, wherein said opening aid device automatically moves said tappet for a time period, in a time-delayed manner, from said second position into said first position after pushing on said closed door leaf.

* * * * *